US012285643B2

(12) United States Patent
Morton

(10) Patent No.: US 12,285,643 B2
(45) Date of Patent: Apr. 29, 2025

(54) PORTABLE WEARABLE RESISTANCE BAND TRAINING APPARATUS

(71) Applicant: Terrell M. Morton, Bethlehem, PA (US)

(72) Inventor: Terrell M. Morton, Bethlehem, PA (US)

( * ) Notice: Subject to any disclaimer, the term of this patent is extended or adjusted under 35 U.S.C. 154(b) by 288 days.

(21) Appl. No.: 17/822,745

(22) Filed: Aug. 26, 2022

(65) Prior Publication Data

US 2023/0065438 A1 Mar. 2, 2023

Related U.S. Application Data

(60) Provisional application No. 63/237,224, filed on Aug. 26, 2021.

(51) Int. Cl.
*A63B 21/055* (2006.01)
*A63B 21/00* (2006.01)

(52) U.S. Cl.
CPC ..... *A63B 21/0557* (2013.01); *A63B 21/4005* (2015.10)

(58) Field of Classification Search
CPC ..... A63B 21/0557; A63B 21/4005; A63B 23/1236; A63B 21/4025; A63B 21/4033; A63B 21/4035; A63B 23/03541
See application file for complete search history.

(56) References Cited

U.S. PATENT DOCUMENTS 1,402,179 A 1/1922 Piscitelli
4,911,439 A 3/1990 Kuhl
5,234,395 A * 8/1993 Miller ..... A63B 21/018 482/114
5,769,764 A * 6/1998 Tilberis ..... A63B 23/03575 482/126
5,792,034 A 8/1998 Kozlovsky
5,820,533 A * 10/1998 Goldman ..... A63B 21/4025 482/125
5,916,070 A 6/1999 Donohue
6,007,463 A * 12/1999 Wells ..... A63B 21/4003 482/122
6,099,446 A * 8/2000 Johnson ..... A63B 21/4005 482/124
6,244,998 B1 6/2001 Hinds
6,287,242 B1 * 9/2001 Fray ..... A63B 21/4015 482/121

(Continued)

FOREIGN PATENT DOCUMENTS

AU 2013218756 B2 8/2013
CA 2658198 A1 * 9/2009 ..... A63B 21/0004

(Continued)

OTHER PUBLICATIONS

International Application No. PCT/US22/75548—International Search Report and Written Opinion, 17 pages.

*Primary Examiner* — Andrew S Lo
(74) *Attorney, Agent, or Firm* — Wilkinson Law Office; Clinton H. Wilkinson

(57) ABSTRACT

A portable, wearable resistance band training apparatus having at least one resistance device secured in a channel of a strap portion forming shoulder straps, and a plurality of access openings in the shoulder strap portion for grasping and extending the resistance device from the sleeve for performing one or more resistance training exercises.

20 Claims, 15 Drawing Sheets

(56) References Cited

U.S. PATENT DOCUMENTS

| | | | | |
|---|---|---|---|---|
| 7,549,945 | B2 | 6/2009 | Shibata et al. | |
| 7,608,026 | B1 | 10/2009 | Nicassio | |
| 7,744,512 | B2 | 6/2010 | Clarke | |
| 7,854,694 | B1 | 12/2010 | Frunzi | |
| D635,203 | S | 3/2011 | Breibart | |
| 7,931,572 | B1 | 4/2011 | Glauser et al. | |
| D644,280 | S | 8/2011 | Marotta | |
| 7,998,041 | B1 | 8/2011 | Johnson | |
| 8,012,071 | B2 | 9/2011 | Grisdale | |
| D698,877 | S | 2/2014 | Calvin | |
| 9,061,173 | B1 | 6/2015 | Felkel | |
| 9,295,869 | B2 | 3/2016 | Washington | |
| 9,610,471 | B1 * | 4/2017 | Langlois | A63B 21/4013 |
| 9,737,752 | B2 | 8/2017 | Walter et al. | |
| 10,112,072 | B2 | 10/2018 | Burrell | |
| 10,207,139 | B2 | 2/2019 | Brancato et al. | |
| 10,286,249 | B1 | 5/2019 | Sibhatu | |
| 10,398,923 | B2 * | 9/2019 | Hur | A63B 21/0552 |
| 10,500,430 | B2 | 12/2019 | Ismail | |
| 10,667,941 | B1 * | 6/2020 | Breibart | A63B 21/4007 |
| 10,702,047 | B1 | 7/2020 | Younan | |
| 10,758,771 | B1 * | 9/2020 | Cranke | A63B 21/4015 |
| 10,881,891 | B2 | 1/2021 | Brancato et al. | |
| D933,940 | S | 10/2021 | Grove | |
| 11,331,529 | B1 * | 5/2022 | Cranke | A63B 21/4021 |
| 2003/0083139 | A1 * | 5/2003 | Bickett | A63B 69/0059 473/215 |
| 2003/0092545 | A1 * | 5/2003 | Koscielny | A63B 21/0004 482/124 |
| 2005/0009673 | A1 * | 1/2005 | Harris | A63B 21/4007 482/129 |
| 2005/0137063 | A1 * | 6/2005 | Abdo | A63B 21/4001 482/126 |
| 2005/0282689 | A1 | 12/2005 | Weinstein | |
| 2007/0015640 | A1 | 1/2007 | Demeniuk | |
| 2007/0027419 | A1 * | 2/2007 | Drennan | A63B 21/4025 602/19 |
| 2007/0083975 | A1 * | 4/2007 | Senegal | A63B 21/4017 2/102 |
| 2007/0238591 | A1 | 10/2007 | Makofsky | |
| 2008/0139369 | A1 | 6/2008 | Vigilia | |
| 2009/0062087 | A1 | 3/2009 | Poppinga | |
| 2009/0082183 | A1 * | 3/2009 | Haynes | A63B 21/1609 482/122 |
| 2009/0258768 | A1 * | 10/2009 | Clarke | A63B 21/151 482/124 |
| 2009/0312163 | A1 | 12/2009 | Hern | |
| 2012/0157273 | A1 * | 6/2012 | Tussy | A63B 21/4019 482/124 |
| 2012/0329617 | A1 | 12/2012 | Tal et al. | |
| 2014/0315699 | A1 * | 10/2014 | Winbush | A63B 69/0028 482/139 |
| 2015/0196790 | A1 * | 7/2015 | Escueta | A63B 21/0603 482/110 |
| 2015/0306454 | A1 * | 10/2015 | Winbush | A63B 23/0405 482/13 |
| 2016/0023080 | A1 * | 1/2016 | Gregory | A63B 69/002 473/422 |
| 2017/0028244 | A1 * | 2/2017 | Schreiber | A63B 21/4007 |
| 2017/0028245 | A1 * | 2/2017 | Williams | A63B 21/4019 |
| 2018/0036161 | A1 * | 2/2018 | Alvarez | A63B 21/0442 |
| 2018/0056104 | A1 * | 3/2018 | Cromie | A61H 3/00 |
| 2018/0193686 | A1 * | 7/2018 | Adeeko, Jr. | A63B 21/4011 |
| 2018/0200557 | A1 * | 7/2018 | Prospero | A63B 21/0557 |
| 2018/0250544 | A1 * | 9/2018 | Hur | A63B 21/4003 |
| 2020/0086162 | A1 * | 3/2020 | Garcia | A63B 21/4007 |
| 2020/0121968 | A1 * | 4/2020 | Ismail | A63B 21/1681 |
| 2022/0264967 | A1 * | 8/2022 | Bassoo | A63B 21/4007 |
| 2024/0207668 | A1 * | 6/2024 | Neely | A63B 21/4019 |

FOREIGN PATENT DOCUMENTS

| | | | | |
|---|---|---|---|---|
| CA | 2859722 | A1 * | 8/2013 | A61F 5/026 |
| WO | WO-9948566 | A1 * | 9/1999 | A63B 21/0023 |
| WO | WO-2019094675 | A1 * | 5/2019 | A61F 5/026 |

* cited by examiner

PORTABLE WEARABLE RESISTANCE BAND TRAINING APPARATUS

CROSS REFERENCE TO RELATED APPLICATIONS

This application claims priority from U.S. Provisional Application Ser. No. 63/237,224 filed on Aug. 26, 2021, the entire contents of which are incorporated herein by reference.

FIELD OF THE INVENTION

The present invention relates to physical fitness and strength training equipment generally, and more particularly to a lightweight, wearable resistance training apparatus incorporating one or more resistance bands which are removably housed in a shoulder strap and are selectively extendable therefrom at different locations along a longitudinal length of the strap for performing resistance exercises, and more particularly still to a portable wearable resistance band training apparatus for resistance training both the upper and lower body which in one or more embodiments may incorporate a detachable backpack, cell phone case, and other accessories.

BACKGROUND OF THE INVENTION

There are many devices designed to exercise or train the upper body and/or lower body, both for fitness and rehabilitation/physical therapy purposes. Unfortunately, many of them are bulky and expensive, or require access to a gym. The use of tension or resistance bands in training or exercising has increased in popularity, as such bands are relatively inexpensive, easy to store and use, are effective in improving overall strength, flexibility and mobility, and can be used in performing a wide variety of exercises for the whole body. Nevertheless, it can be inconvenient to carry a resistance band on one's person, particularly while engaging in sports or training activities such as biking and jogging, and also for the band to be readily accessible for use. A wearable apparatus for holding a resistance band while performing other training or non-training activities, wherein the resistance band is positioned on the wearable apparatus to be readily used, would be desirable.

At the same time, backpacks are convenient for carrying and storing items while leaving the hands free. Backpacks are available in various sizes and may be customized for use with particular sports activities such as running, biking, climbing, skating, etc. A conventional backpack suspension system includes a pair of adjustable shoulder straps which connect between upper and lower portions of the main body of the backpack. The shoulder straps extend around the shoulders, downwardly over the chest muscles and around the wearer's sides, connecting back to the backpack main body. A hip belt may also be used to transfer some of the weight of the backpack from the shoulder straps to the hips and legs, while a sternum strap or belt connecting between the shoulder straps provides greater stability.

The shoulder straps preferably should fit snugly around the wearer's body. When worn, the shoulder straps of a bookbag are positioned generally over the same area of the upper torso where the hands are located in commencing performance of various upper body exercises, including but not limited to a straight bench press, incline and recline bench press, and an overhead press. It therefore would be convenient to provide a lightweight, wearable training apparatus including a pair of shoulder straps with one or more resistance bands housed in the shoulder straps which can be quickly and easily gripped and extended from the shoulder straps at different locations to be utilized in performing training exercises by the person wearing the resistance training apparatus. The resistance band also should be retractable into elongated sleeves in the shoulder straps when not in use and substantially concealed during storage. It would also be desirable if the resistance band could be used when the training apparatus is not being worn and/or could be completely removed from the shoulder straps and used separately in performing a wide range of different exercises. In addition, a backpack which can be detachably connected to and used with such a wearable training apparatus would be convenient. While numerous arrangements are available for connecting a resistance band to the user, the present invention is neither taught nor rendered obvious by such known arrangements.

SUMMARY OF THE INVENTION

The present invention provides a wearable resistance training apparatus including a shoulder strap which may be extended and secured over at least the neck and chest area of the wearer. The shoulder strap forms a sleeve having a longitudinally extending internal compartment or channel in which at least one elastic resistance device is housed. The resistance device may be an elastic band. A lateral extension is connected to the shoulder strap in a position adapted to extend downwardly over the upper back of the wearer in proximity of the spine. The lateral extension is adjustably securable to the shoulder strap and/or resistance band along a distal end of the lateral extension. A plurality of openings are formed in the shoulder strap in locations spaced apart along the longitudinal length of the shoulder strap. The openings are located and dimensioned for the resistance band to be accessed, and manually grasped and pulled outwardly through such openings to perform a resistance exercise while wearing the training apparatus. The resistance band may also be released from the distal end of the lateral extension and utilized to perform resistance training exercises while not wearing the training apparatus. The resistance band can be quickly and easily selectively gripped and extended from the shoulder strap at different locations to be utilized in performing training exercises by the person wearing the resistance training apparatus. When the resistance apparatus is not being used, the resistance band may be retracted back through the openings into the elongated channel or compartment, wherein the resistance band is substantially covered and concealed during storage.

In some embodiments, the shoulder strap has a first shoulder strap section and a second shoulder strap section, the lateral extension is secured to the shoulder strap at a connecting point of the first and second shoulder strap sections. In some embodiments the lateral extension has a proximal end which is connected to the shoulder strap, and a distal end, wherein one or more openings is provided in the lateral extension spaced inwardly from the distal end in which a portion of elastic resistance band is received and secured.

In some embodiments, the first and second shoulder strap sections each have a distal end which is open to the internal compartment or channel of the shoulder strap, and the resistance band extends out of the distal ends of the first and second shoulder strap sections when secured in the internal compartment or channel, wherein the resistance band is formed as a continuous loop.

In some embodiments, after a looped portion of the resistance band is passed through one of the openings in the lateral extension, the resistance band is secured to the lateral extension such as by forming a knot in the resistance band, and the remaining looped portion of the resistance band is secured in a pocket formed in the lateral extension.

In some embodiments, the shoulder strap comprises a sleeve having a side wall, a first end and an opposing second end, and a channel extending between the first end and second end in which at least a portion of the resistance device is received so as to at least partially envelope the resistance device, the sleeve having a plurality of spaced-apart openings in the side wall through which the elastic resistance apparatus is accessible to the user for performing resistance exercises.

In some embodiments of the resistance training apparatus, the elastic resistance device is formed in a continuous closed loop.

In some embodiments, the resistance training apparatus includes a sleeve formed in the lateral extension having an open outer end adapted to receive a portion of the elastic resistance device passed through the aperture in the distal end of the lateral extension, for adjusting the length of the resistance apparatus.

In some embodiments, the resistance training apparatus includes a cover attached extending outwardly from the open outer end of the sleeve formed in the lateral extension adapted for covering a portion of the resistance apparatus passed through the aperture.

In some embodiments, the resistance training apparatus includes a first portion extending between the first end and the lateral extension, and a second portion extending between the opposing second end and the lateral extension, the first and second portions forming shoulder straps.

In some embodiments, a backpack is detachably connectable to the training apparatus.

BRIEF DESCRIPTION OF THE DRAWINGS

The present invention will become more fully understood from the detailed description and the accompanying drawings, which are incorporated in and constitute a part of this specification, wherein.

DETAILED DESCRIPTION OF THE INVENTION

Figure 1:
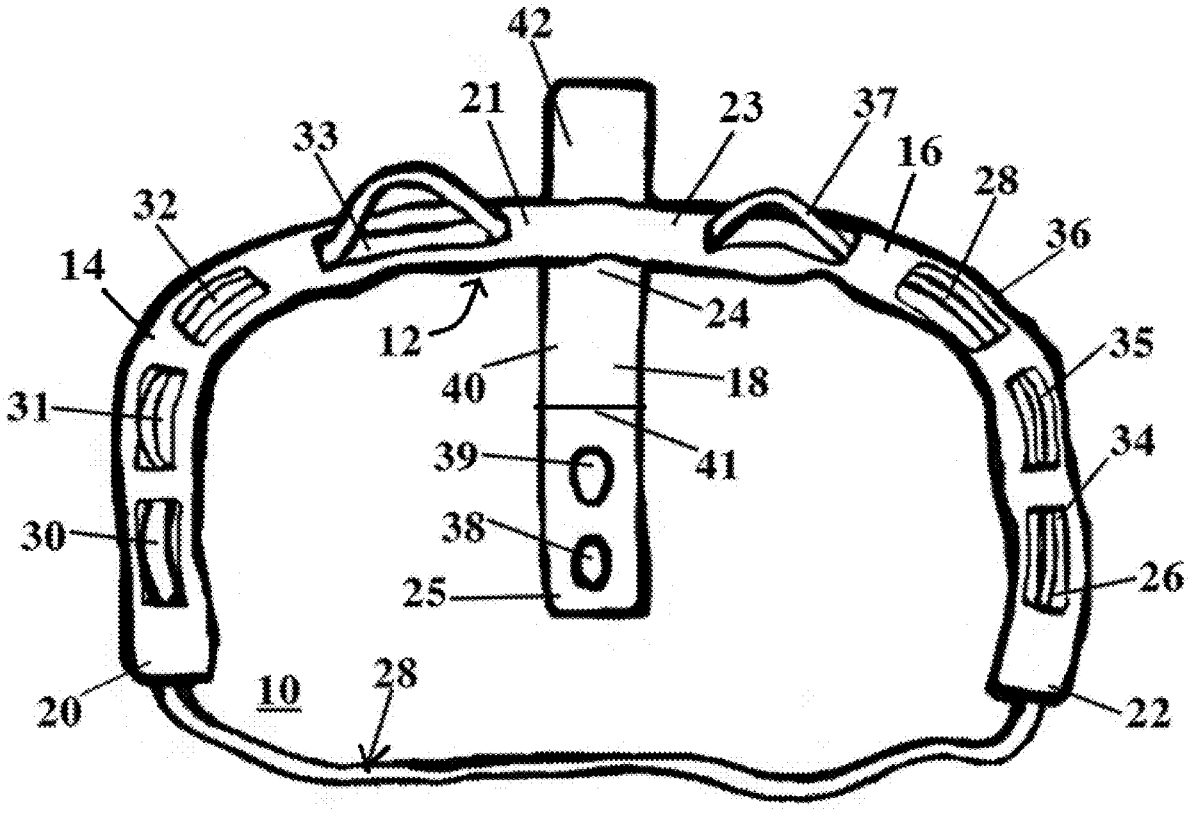
FIG. 1 is an elevation view of an embodiment of a portable wearable resistance band training apparatus in accordance with the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. The components in the drawings are not necessarily drawn to scale, the emphasis instead being placed upon clearly illustrating the principles and manner of use of the invention. Moreover, in the drawings, like reference numerals designate corresponding parts throughout the several views. Wherever possible, the same reference numbers are used throughout the drawings to refer to the same or like elements of an embodiment.

Referring now in particular to FIGS. 1-4, an embodiment of the wearable resistance band training apparatus 10 of the present invention is shown, while FIGS. 5-10 illustrate performance of several different exercises using the training apparatus 10. Training apparatus 10 generally includes a shoulder strap 12 having a first shoulder strap portion 14 and a second shoulder strap portion 16, a back portion 18 connected extending laterally from shoulder strap 12 at an intersection between the first and second shoulder strap portions 14 and 16, and a resistance device 28 connected to shoulder strap 12 as will be described. First shoulder strap portion 14 has a distal end 20 and a proximal end 21, and second shoulder strap portion 16 similarly has a distal end 22 and a proximal end 23. Laterally extending back portion 18 also has a proximal end 24 and a distal end 25. First and second shoulder strap portions 14 and 16 may be straight or curved and dimensioned as needed for shoulder strap 12 to be comfortably and snugly positioned extending behind the neck and over the shoulders and chest or pectoralis major of the wearer, with distal ends 20 and 22 extending around the sides of the torso.

Shoulder strap 12 and back portion 18 of training apparatus 10 are made of a suitably strong and flexible material such as but not limited to a nylon fabric or canvas material. Strap 12 may be formed of separate elongated panels of said material which are connected along aligned side edges of the panels by a suitable fastening means including but not limited to sewing, hook and loop (Velcro®) fasteners, an adhesive, or heat-sealing process. Strap 12 may also be formed as a single elongated panel which has been cut and then folded along its longitudinal axis and the opposite side edges secured together by similar attachment methods along the longitudinal length of the strap 12. In other embodiments, shoulder strap portions 14 and 16 may be formed separately and connected along proximal ends 21 and 23. A longitudinally extending internal compartment or channel 26 is formed in the shoulder strap 12 in a space between the strap material panels. Internal channel 26 in the illustrated embodiment extends the entire length of the shoulder strap 12 within the first shoulder strap portion 14 and second shoulder strap portion 16 between distal ends 20 and 22, which are open into channel 26. Shoulder strap 12 in some embodiments may be tubular, and in other embodiments may have a generally rectangular cross section with opposite side walls, and with channel 26 positioned between the side walls. One side wall of the shoulder strap 12 which in use will be situated against the wearer's shoulders may be lined with a cushioning or padding material, which may a synthetic rubber or neoprene material or other suitable natural or synthetic material, in order to cushion and distribute the weight of the training apparatus 10 and absorb and redistribute forces exerted on the body during use of the present invention in performing resistance exercises. In some embodiments the entire outer wall of the shoulder strap 12 may be similarly lined with a cushioning or padding material.

At least one resistance device 28, which may be an elastic resistance band made of a latex or synthetic rubber, is positioned extending within the internal channel 26 of shoulder strap 12, without being secured against longitudinal sliding in the channel 26, such that the strap 12 forms a cover or sleeve over the resistance device 28. In the illustrated embodiment, resistance band 28 is provided as a continuous closed loop positioned extending within the entire longitudinal length of first and second shoulder strap portions 14 and 16, and also connecting between the distal ends 20 and 22 of the strap portions 14 and 16. In other embodiments, the ends of resistance band 28 may be separately inserted into channel 26 at distal ends 20 and 22 of the strap portions 14 and 16 and then connected in the vicinity of laterally extending back portion 18. Where a hook and loop fastener is used to connect the side edges of the shoulder strap 12, the strap 12 can be opened and closed for inserting and or removing the resistance band 28 in channel 26, such that the resistance band 28 can be interchanged with a replacement band or other resistance bands, for example, having different resistance/weight parameters.

A plurality of spaced-apart cutouts or openings 30, 31, 32, and 33 are formed in the side wall of first shoulder strap portion 14, which in some embodiments may be an unpadded portion of the shoulder strap 12. In addition, a plurality of spaced-apart cutouts or openings 34, 35, 36, and 37 are similarly formed in the side wall of second shoulder strap portion 16. In the event the entire side wall or both side walls of shoulder strap 12 are padded, the cutouts or openings will be formed in the same circumferential position on the side wall or on the same side wall which may be the front side wall. Cutouts or openings 30-33 and 34-37 in the shoulder strap portions 14, 16, respectively, connect with channel 26 and provide access to portions of the resistance band 28 within channel 26 positioned at such openings. In an embodiment, cutouts or access openings 30-33 and 34-37 are similarly sized, and pairs of access openings 30 and 34, 31 and 35, 32 and 36, and 33 and 37 are aligned or similarly positioned on the first and second strap portions 14 and 16, respectively. The access openings 30-33 and 34-37 are preferably wide enough for the resistance band 28 extending within channel 26 to be easily manually grasped in one hand with at least two fingers, or with the thumb, extending underneath the band so as to be pulled outwardly from the sleeve through the opening. In an embodiment, each of the openings has a longitudinal length of about 3-4 inches. In other embodiments, the openings are positioned to facilitate performance of particular resistance exercises using the apparatus 10.

Referring now to the back portion 18, apertures 38 and 39 are formed in back portion 18 spaced inwardly from the distal end 25 of back portion 18, with aperture 39 spaced further away from distal end 25 than aperture 38. A pocket 40 is also formed in back portion 18 situated between aperture 39 and proximal end 24, which pocket 40 is accessible at open end 41 which opens towards apertures 38 and 39. Another short lateral extension 42 is connected to the shoulder strap 12 extending in the opposite direction from back portion 18. One purpose of extension 42 is to serve as a position indicator when putting on and wearing the training apparatus 10.

Figure 2:
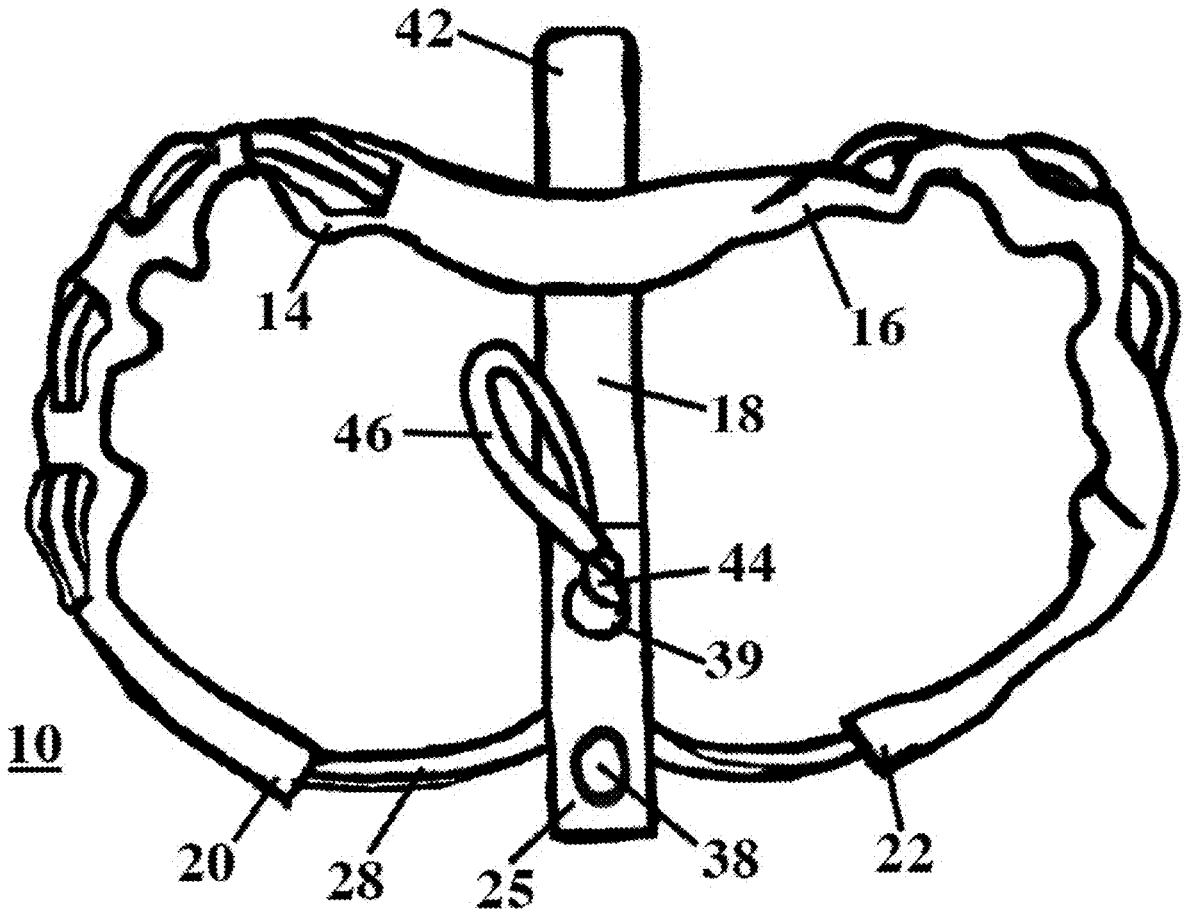
FIG. 2 is another elevation view of the wearable training apparatus shown in FIG. 1 illustrating the adjustable resistance band secured to a back portion.

The open distal ends 20 and 22 of first and second shoulder strap portions 14 and 16 are not directly connected to back portion 18, but may be indirectly connected to the back portion 18 by the resistance band 28. Referring now to FIG. 2, a portion of the resistance band 28 not housed in channel 26 and extending between the outer ends 20 and 22 of first and second shoulder strap portions 14 and 16 is passed through one of the apertures 38 or 39 in back portion 18 from the side opposite pocket 40. The amount or length of the resistance band 28 which is passed through the aperture 38 or 39 will depend on the physical characteristics and requirements of the person using the training apparatus 10, how snug the user wants the shoulder straps portions 14 and 16 to be on their body, and the desired tension on band 28. In FIG. 2, while band 28 is shown being passed through aperture 39, it will be understood that band 28 may be passed through either aperture 38 or 39 in order to adjust the vertical position of the band 28 to suit the size and comfort of the wearer. Back portion 18 may also be manufactured in different lengths to accommodate different adult or children sizes, and additional apertures for receiving band 28 may be provided in back portion 18 as needed.

Figure 3:
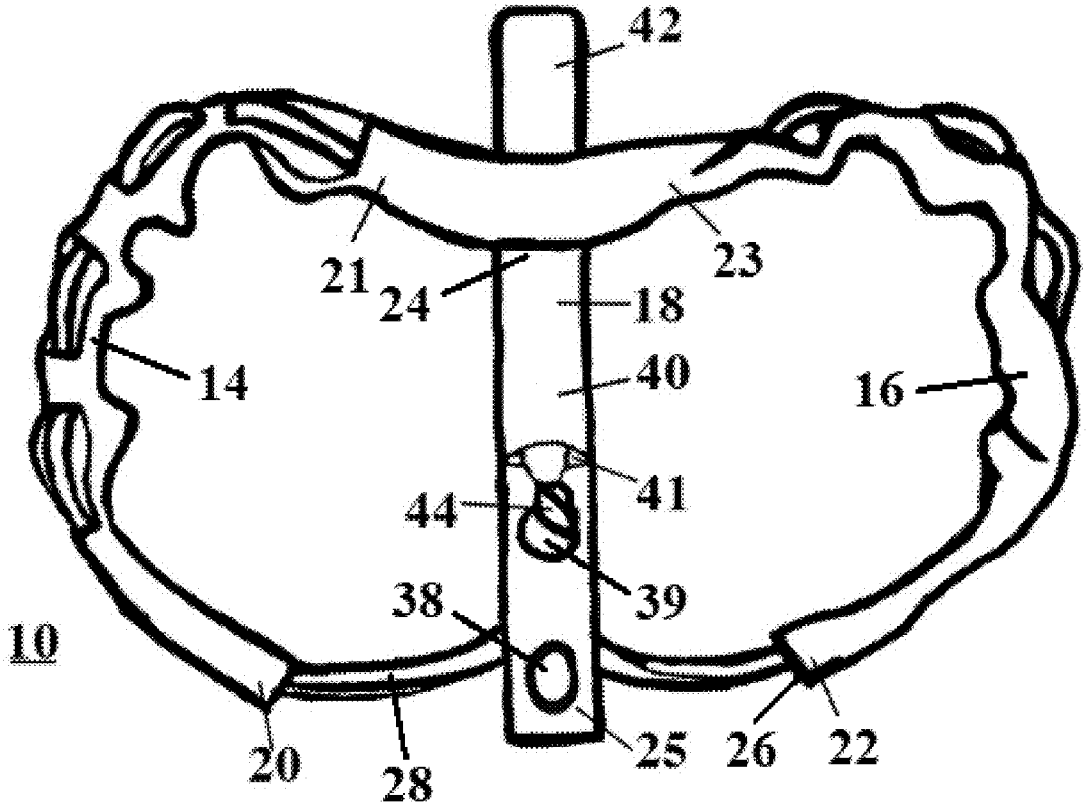
FIG. 3 is another elevation view of the wearable training apparatus as in FIG. 2 showing the looped portion of the resistance band received in a pocket in the back portion.
Figure 4:
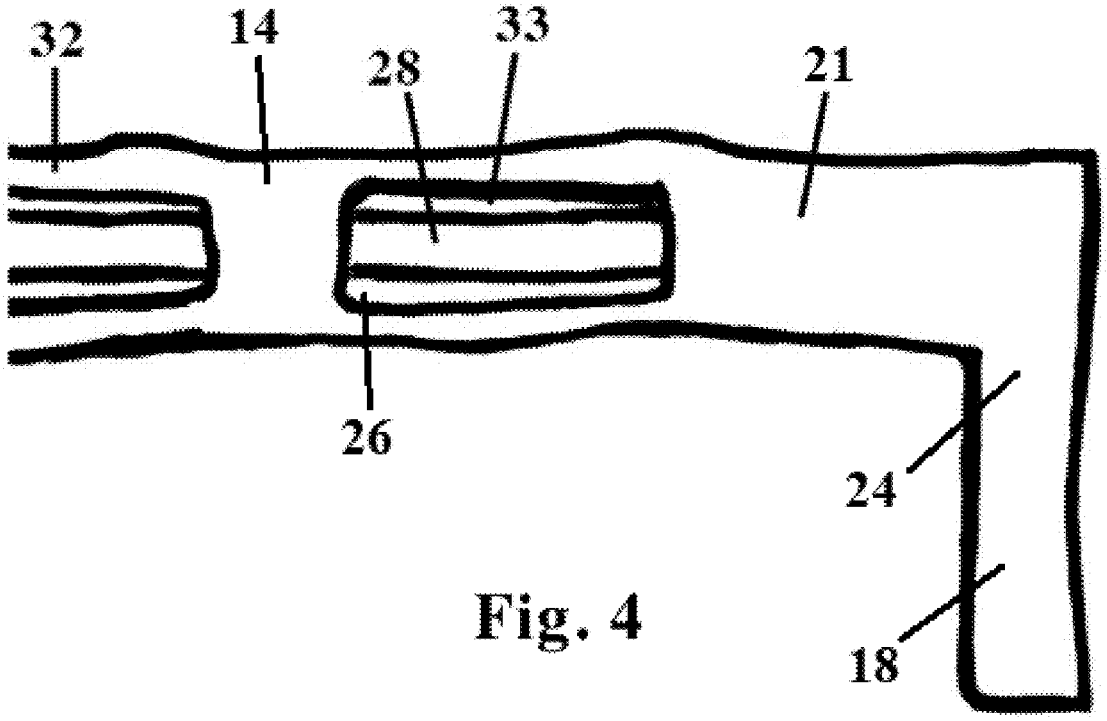
FIG. 4 is a close-up view of a section of the first shoulder strap portion.
Figure 5:
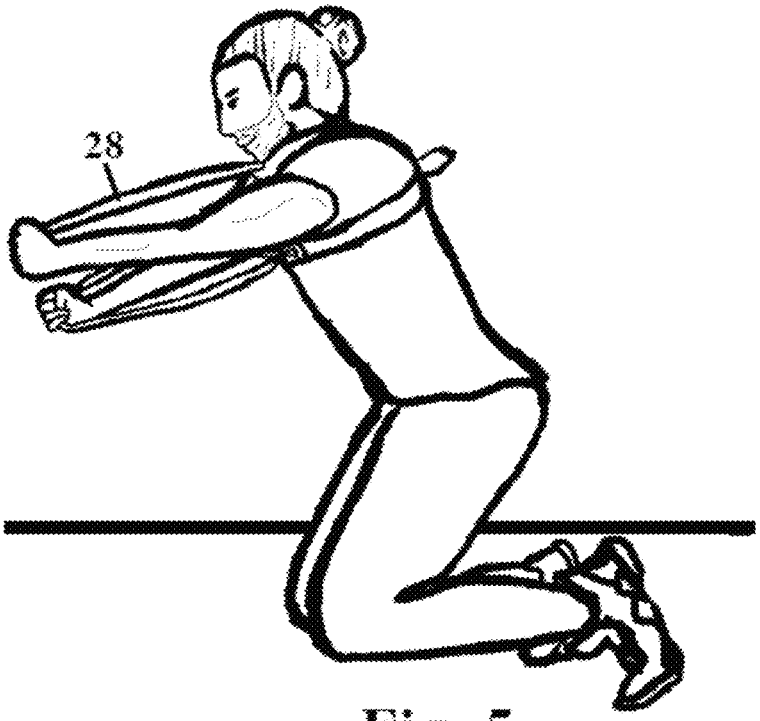
FIG. 5 illustrates performance of a forward press exercise using the training apparatus of the invention.

After a folded or looped portion of the resistance band 28 has been passed through the aperture 38 or 39, the band 28 is secured at the desired length and tension. As shown in FIG. 2, band 28 may be secured by tying a knot 44 in the portion of band 28 passed through the aperture, wherein the knot 44 will be larger than the aperture 38 or 39 which prevents the knot 44 from passing back through the aperture 38 or 39 without first being untied. Knot 44 will also form a loop or handle portion 46 in the band 28, the size of which will depend on the desired tension. As shown in FIG. 3, the loop or handle portion 46 may be inserted in opening 41 into storage pocket 40 in the back portion 18. In some embodiments, knot 44 may also be covered or protected by a flap or panel on the back portion 18 which is securable extending over the knot 44. It will be understood that the band 28 may be secured to the back portion 18 by other suitable arrangements including but not limited to securing a spring fastener or cord lock over the portion of band 28 passed through one of the apertures 38 or 39.

The lightweight, portable, resistance band training apparatus 10 is designed to fit snugly to the upper torso and can be worn while jogging or engaging in various sports, fitness or rehabilitation activities, either over an upper body garment such as a t-shirt or other workout wear, or directly against the skin. In addition, the training apparatus 10 can be worn comfortably while sitting, driving or while performing everyday activities prior to commencing an exercise session or between sessions. The training apparatus 10 is light, mobile, and highly effective for common and dynamic exercises that can be performed on the go. The device also gives users added independence and mobility with regard to exercising, saves time, and reduces the need of gyms, personal trainers, and large, expensive pieces of exercise equipment.

After the loop 46 is secured in pocket 40 of back section 18, the training apparatus 10 can be put on in the same way as a conventional backpack or bookbag. The overall function of the training apparatus 10 is to give maximum mobility for resistance training. Exercises such as resisted push ups, dips, squats, and boxing can all be executed from any location while wearing the device. As shown in FIGS. 5-10, the wearer's right arm is passed through the opening formed by first shoulder strap portion 14 and back portion 18, and the wearer's left arm is similarly passed through the opening formed by the second shoulder strap portion 16 and back portion 18. First shoulder strap portion 14 is positioned extending over the user's right shoulder, second shoulder strap portion 16 is positioned extending over the user's left shoulder, with proximal ends 21 and 23 positioned behind the neck, and back portion 18 is positioned over the user's back extending downwardly from the rear neck area generally in alignment with the center of the back and spine. Short extension 42 which is positioned at the midpoint between the shoulder strap portions 14 and 16 and is aligned with lateral extension 18 assists the user visually in properly centering the lateral extension 18 over the back. Distal ends 20 and 22 of shoulder strap portions 14 and 16 will be positioned extending downwardly around the user's right and left side, respectively.

When the exercise training apparatus 10 is worn as described above, a wide range of different resistance exercises can be easily performed using the apparatus 10 with only a minimum amount of preparation required. As an example, while either sitting or standing, first the resistance band 28 can be grasped in opening 33 with the right hand and in opening 37 with the left hand and pulled outwardly. Then, while grasping the band 28, the user can extend his or her arms outwardly and upwardly to perform an overhead press or shoulder press. No separate handle attached to the band 28 is required. To perform an incline bench press movement, the user simply has to move his or her body into an incline position, grasp the resistance band 28 in opening 32 with the right hand and in opening 36 with the left hand, and then while grasping the band 28 extend his or her arms outwardly to perform an incline press. This resistance exercise is illustrated being performed in an upright, kneeling position in FIG. 5. To perform a bench press, the user simply has to grasp the resistance band 28 in opening 31 with the right hand and in opening 35 with the left hand, and then press outwardly on the band with both hands to perform a bench press movement. To perform a decline press movement, the user simply has to grasp the resistance band 28 in opening 30 with the right hand and in opening 34 with the left hand, and then push or extend the arms outwardly while gripping the band in both hands to perform a decline bench press movement. It will be understood that such exercises can be performed with both arms at the same time, or with one arm at a time, or in an alternating movement. In addition, various modifications of such exercises at slightly different angles or with the body in different positions can be performed with no modifications to the training apparatus being required. When an exercise is completed, the user then simply has to pull downwardly on the shoulder strap portions 14 and 16 along distal ends 20 and 22, which will cause the portion of the resistance band 28 extended from channel 26 through one of the openings to retract back into the channel 26, such that the band 28 is stored in channel 26 when not in use and is out of the way and will not inadvertently catch on close-by objects while wearing the training apparatus 10.

Figure 6:
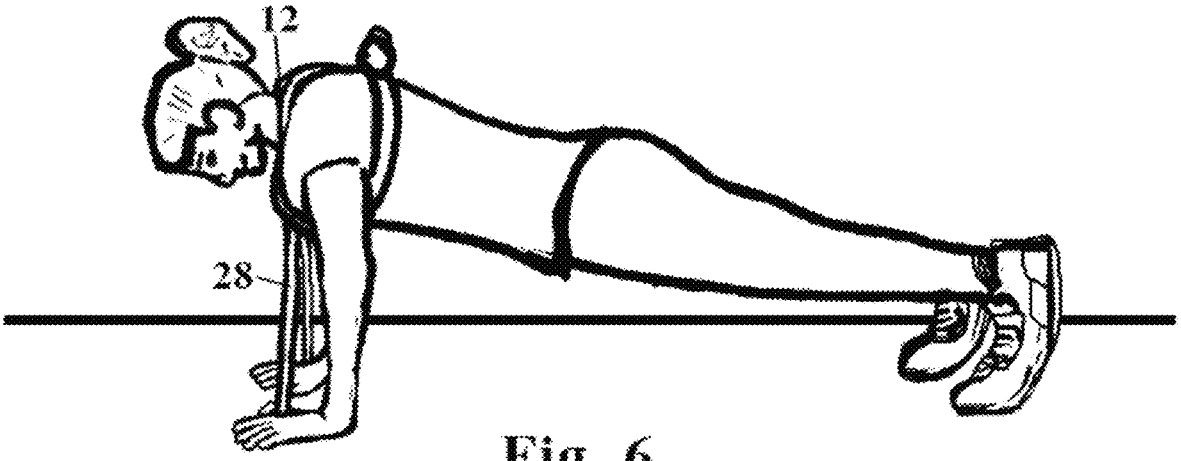
FIG. 6 is a side view illustrating performance of a push-up exercise using the training apparatus of the invention.
Figure 7:
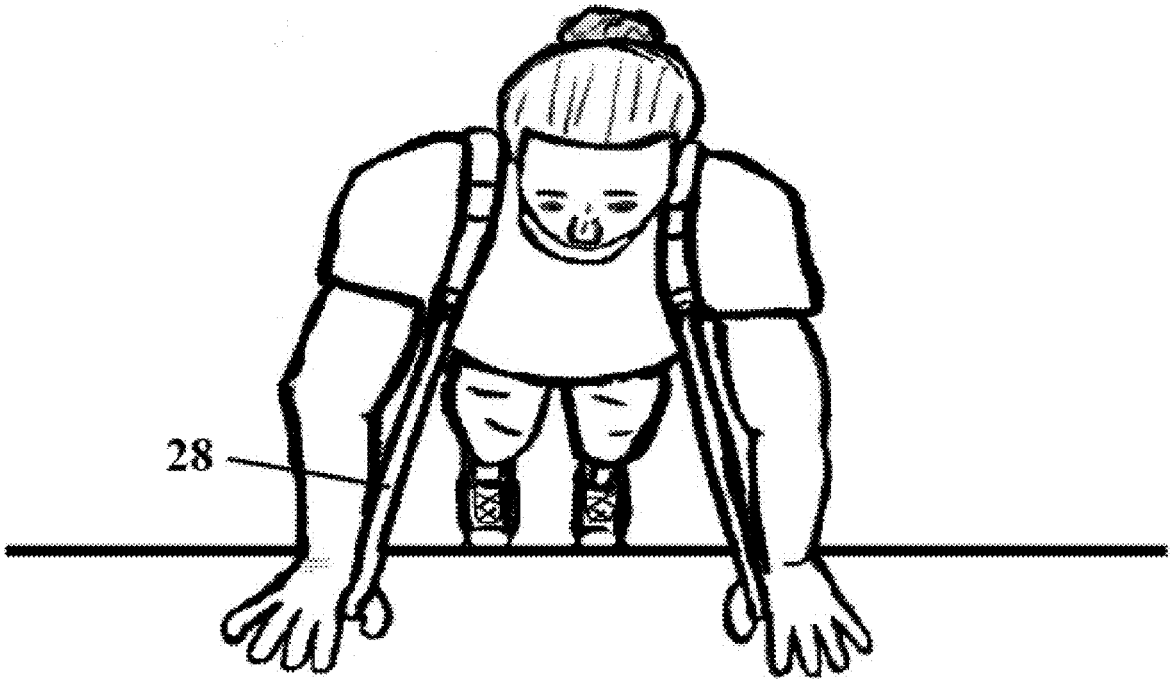
FIG. 7 is a front view illustrating performance of a push-up exercise as in FIG. 6.
Figure 8:
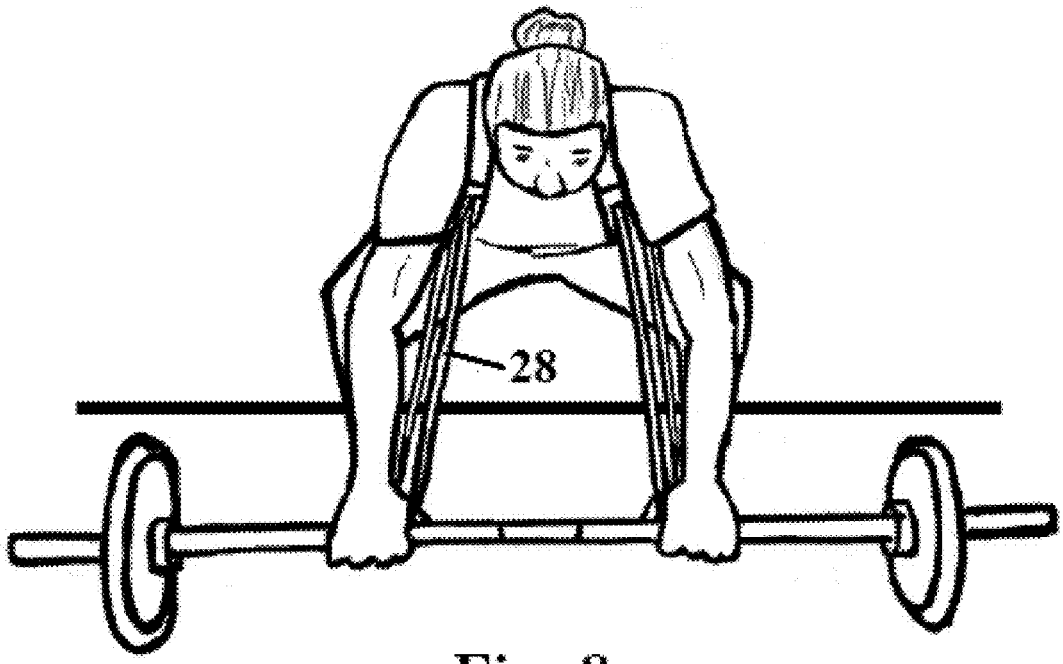
FIG. 8 is a front view illustrating performance of a barbell lift exercise using the training apparatus of the invention.

A wide range of other both upper and lower body exercises can also be performed using the training apparatus 10. For example, FIGS. 6 and 7 illustrate use of the resistance band training apparatus 10 while performing pushups, wherein the band 28 is grasped in the hands and extended while performing the push-up exercise in order to increase the resistance on the arms. FIG. 8 illustrates use of the apparatus 10 while lifting an Olympic barbell, wherein again by grasping the band 28 in the hands an additional resistance is provided during performance of the exercise. The openings in the shoulder strap through which access to the resistance band 28 is provided while wide enough for the wearer to manually grasp the resistance band 28 and pull it outwardly from the channel 26, are still relatively narrow which allows the tension of the band to be focused between two relatively closely spaced points on the strap 12, namely the side walls of the strap adjacent the selected opening. The resistance points of the band with respect to the strap therefore are narrowly spaced which improves and focuses the directionality of the exercise apparatus in comparison to a resistance band connected between to widely spaced attachment points. For example, if a bench press is performed, the tension on the resistance band should be aligned as closely as possible with the muscles performing a major portion of the work, such that the band tension is aligned with the direction of movement of the body part performing such work. Providing multiple spaced-apart openings on the first and second shoulder strap portions allows the user to select the origin point of the tension that is most closely aligned with the major direction and angle of the exercise being performed.

Figure 9:
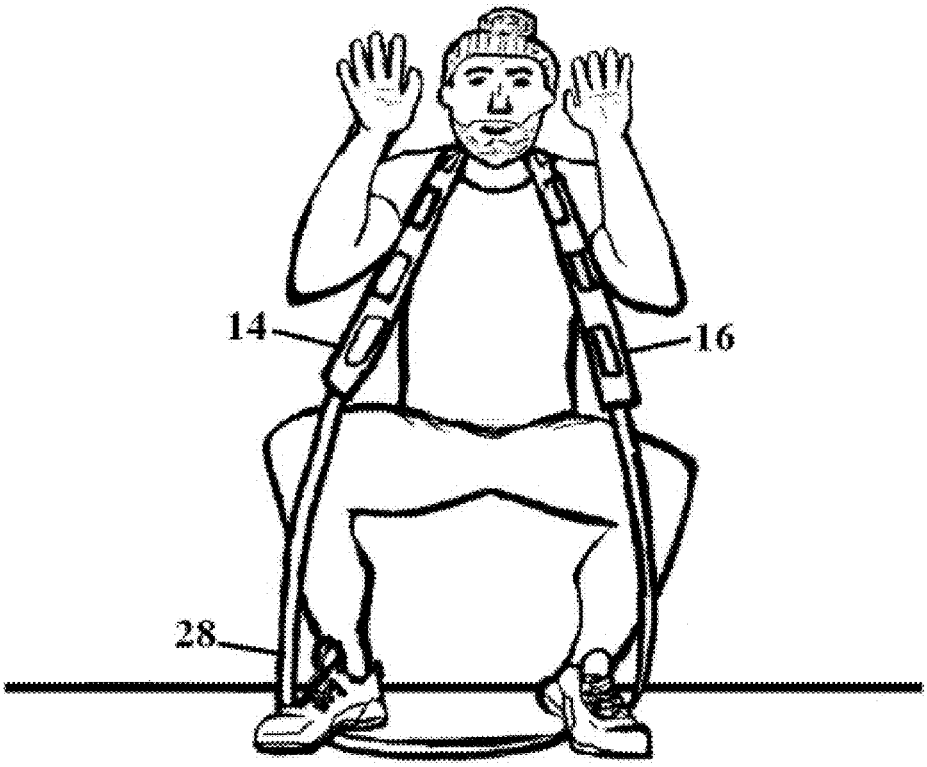
FIG. 9 is a front view illustrating performance of a a leg squat exercise using the training apparatus of the invention.
Figure 10:
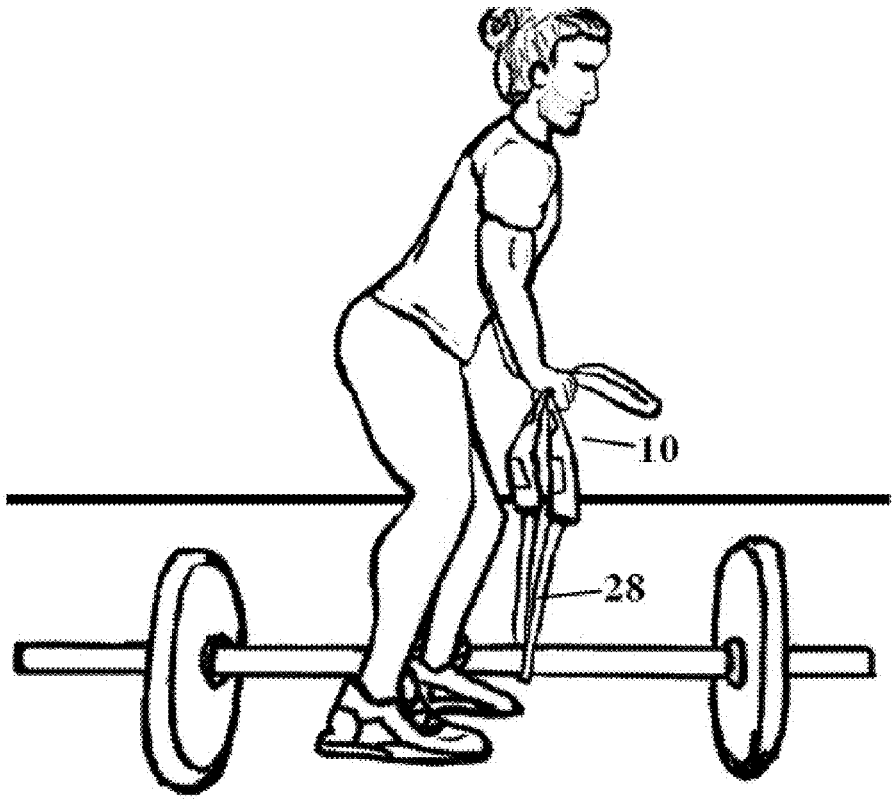
FIG. 10 is a side view illustrating performance of an upper body rotation exercise using the training apparatus of the invention.

In FIG. 9, the resistance band 28 has been detached from the back portion 18 by untying the knot 44 and releasing the band 28 from the aperture 38 or 39 in back portion 18. The user then may use the resistance band training apparatus 10 while performing lower body squat exercises to provide additional tension or resistance by placing a portion of the resistance band 28 not in channel 26 on the floor and then standing on the resistance band 28 with one or both feet such that the band 28 extends upwardly towards the first and second shoulder strap portions 14 and 16 along the outer side surface of the legs. In FIG. 10, the resistance band training apparatus 10 is shown in use with the apparatus 10 having been removed from around the user's shoulders, and with the resistance band 28 now secured to a heavy object such as a weighted barbell. The band 28 and strap 12 are being grasped in the user's hand and can be used to provide additional resistance while performing standing twist exercises, as well as a variety of other exercises. The training apparatus 10 thus maintains all of the advantages of using an individual resistance band while making performance of many different resistance band exercises ordinarily performed using weights or other exercise machines readily available for immediate use.

In another embodiment, instead of a single resistance band 28, a plurality of resistance bands may be secured in the channel 26 of the first and second shoulder strap portions 14 and 16 of the exercise training apparatus 10. In such an arrangement, the bands may have different tensions or resistance levels ranging from light, medium, and heavy. In addition, the shoulder strap 12 may be manufactured in different widths both to accommodate the number of bands 28 in the channel 26 and to provide an adequate surface area to comfortably distribute the force of the device 10 on the wearer's body. One or more hand grips or loops may also be attached to the distal end 25 of back portion 18, which may be used in performing additional resistance band exercises when the apparatus 10 is being utilized without being worn as in FIG. 10. At least one hand grip formed on the distal end 25 of the back portion 18 may be the same material containing the apertures 38 and 39 through which the band 28 is passed to secure the band 28 to the back section 18. In other embodiments, the training apparatus 10 may include additional attachments and features, such as a neoprene bag attachment to carry items, phone case, gloves, wrist and ankle straps.

Figure 11:
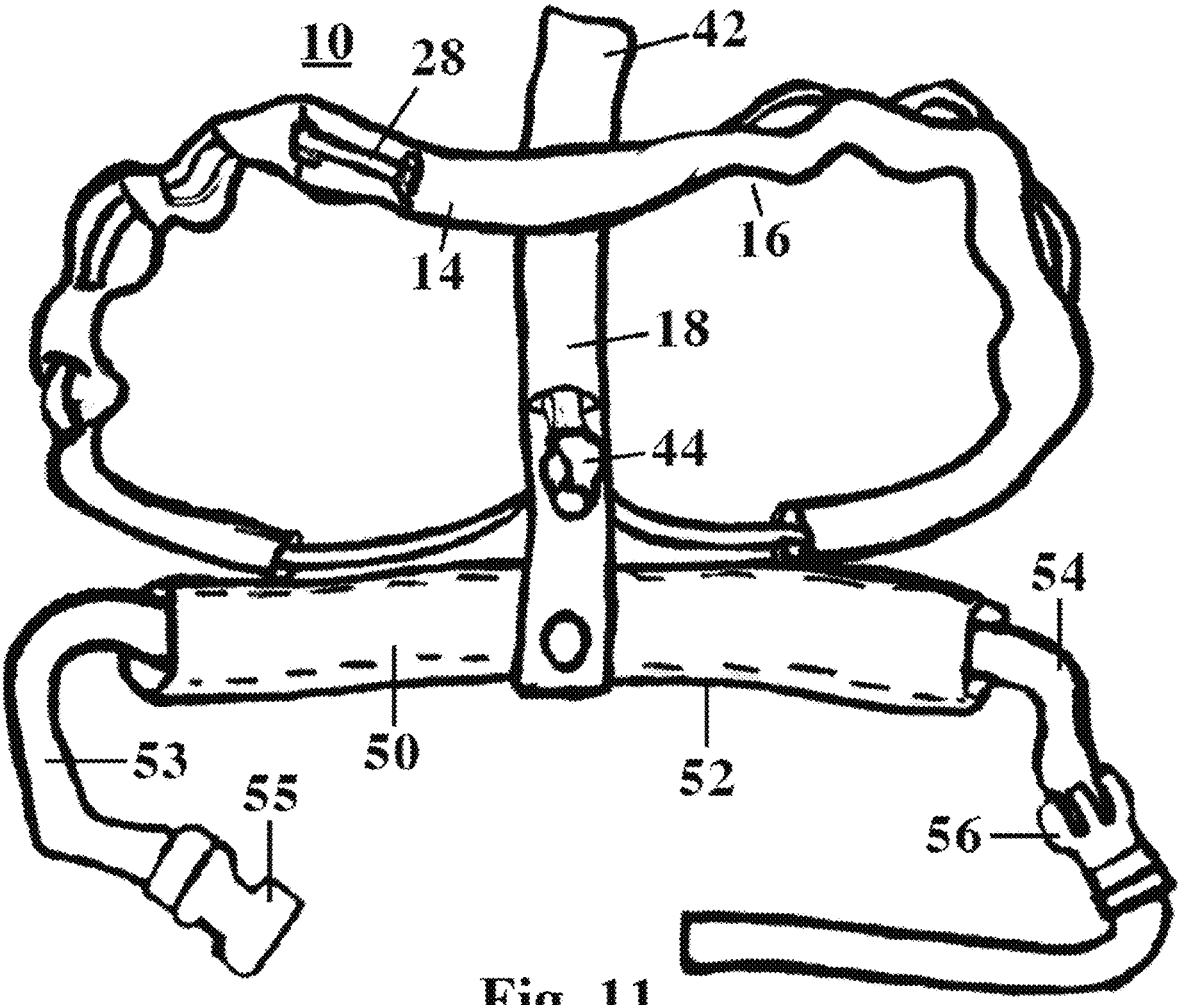
FIG. 11 illustrates another embodiment of the wearable training apparatus of the invention additionally including a hip or waist belt.
Figure 12:
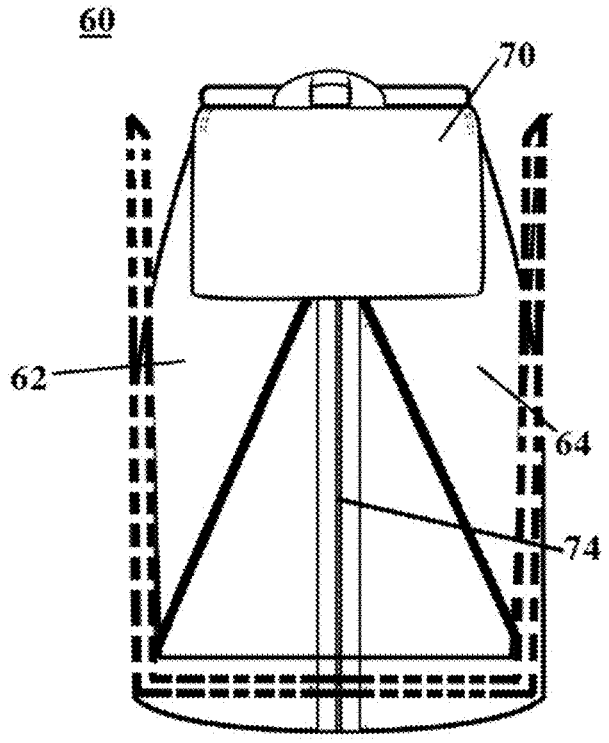
FIG. 12 is a front view of an embodiment of a backpack for use in combination with the training apparatus of the present invention.

FIG. 11 illustrates another embodiment of the wearable exercise apparatus which is similar in construction to the apparatus 10 shown in FIGS. 1-4 except additionally including a padded waist belt 50, which is coupled to the back portion 18 by being slidably inserted or passed through a looped member on the distal end 25 of the back portion 18. Waist belt 50 in the illustrated embodiment includes a wide, padded section 52 which in use is secured extending around the user's back, and adjustable strap sections 53 and 54 which are connected to opposite ends of the padded section 52. The strap sections 53 and 54 extend around the wearer's front torso and are secured together by mating buckle portions 55 and 56. The waist belt 50 when secured around the waist will transfer or redistribute much of the weight of the training apparatus 10 from the shoulders to the hips and legs, which is often desirable particularly in embodiments of the training apparatus 10 in which a backpack or knapsack is detachably secured to the training apparatus 10.

Figure 13:
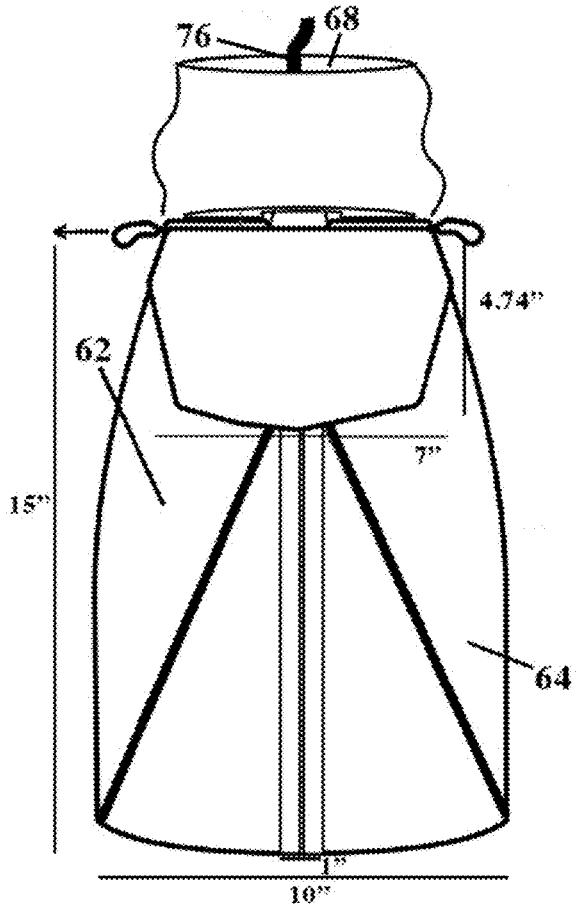
FIG. 13 is another front view of the backpack shown in FIG. 12 with the laptop sleeve open.
Figure 15:
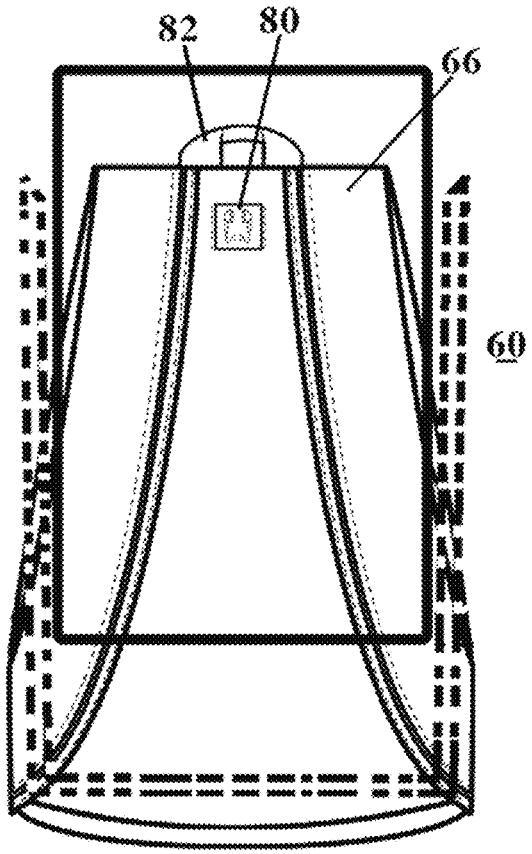
FIG. 15 is another rear view of the backpack shown in FIG. 14 illustrating the position of a laptop carried in the backpack.
Figure 16:
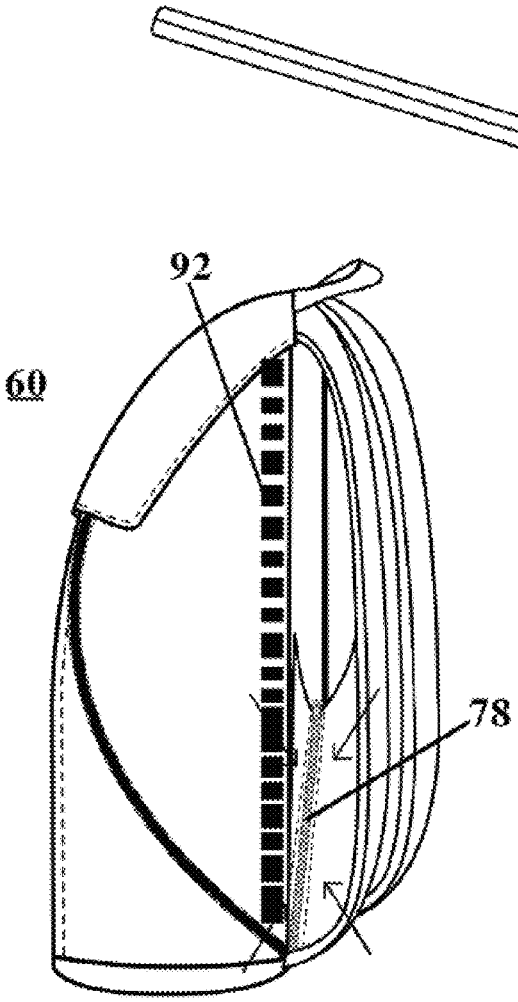
FIG. 16 is a first side view of the backpack.
Figure 17:
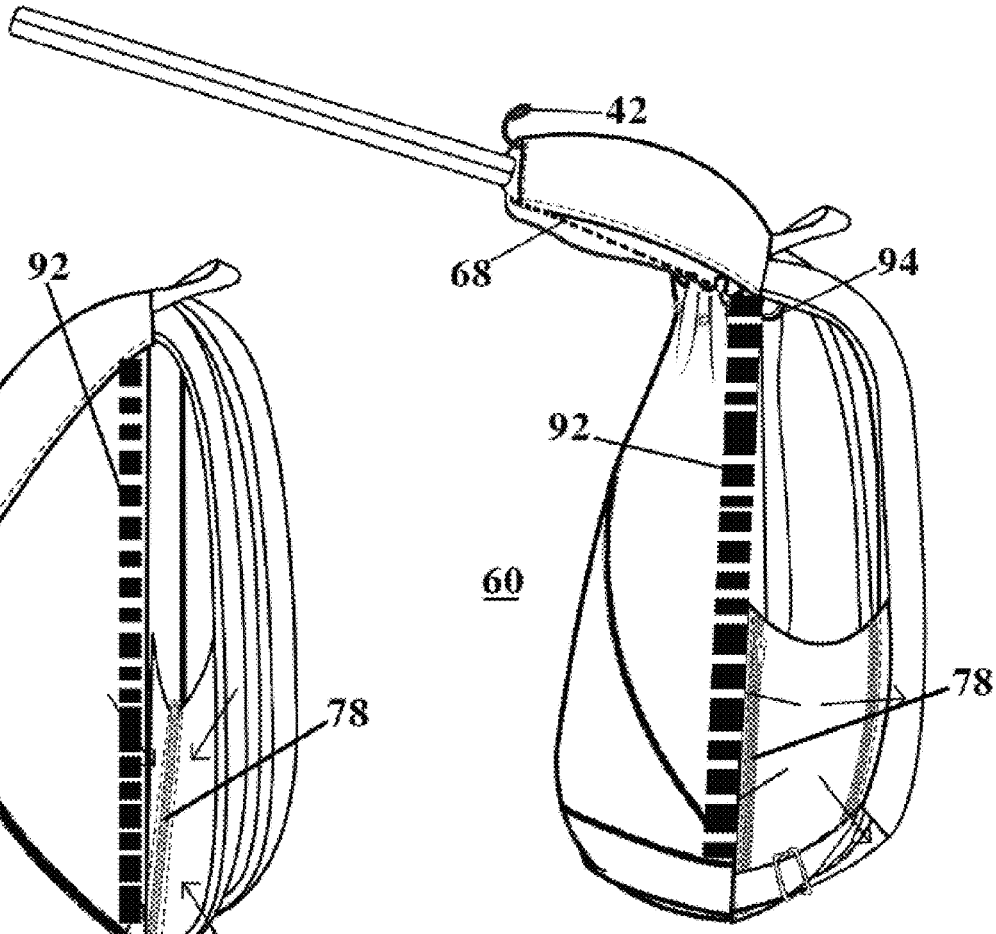
FIG. 17 is another side view of the backpack with the laptop sleeve open.

FIGS. 12-18 and 20 illustrate a backpack 60 configured for use with the training apparatus 10 of the present invention. Backpack 60 has a flexible main body 62 generally having a front side 64 and a rear side 66. An expandable interior compartment in main body 62 includes a sleeve 68 which is configured to receive a laptop, which laptop in an embodiment is a Macintosh® 13 inch or 15 inch laptop. A flap 70 is extendable over front side 64 of main body 62 when the backpack 60 is in a closed position as in FIG. 12, which flap 70 as shown in FIG. 13 pivots upwardly and has an end opening 72 in which the laptop is inserted into the laptop sleeve 68. An enclosed rubber zipper with a pull 74 is provided extending vertically on the front side 64 of the main body 62 of the backpack 60. A laptop pull/drop string 76 is also provided which extends from the sleeve to the bottom of a shock support. When a laptop L is stored in the sleeve 68 of bag 70, pulling upwardly on the string 76 enables the laptop L to be removed from the bag without having to remove the backpack 60 from the wearer's shoulders. As shown in the side views in FIGS. 16 and 17, a zipper closure 78 is provided in a side portion of the bag, which when unzipped as shown in FIG. 17 allows the main body 62 to be further expanded.

Figure 14:
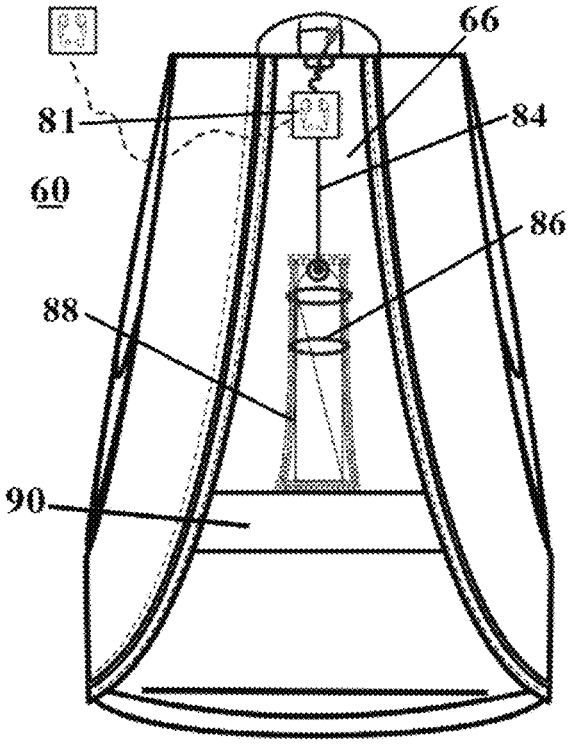
FIG. 14 is a rear view of the backpack shown in FIG. 12.

As best shown in FIGS. 14 and 15, backpack 60 also includes a small compartment 80 for storing a pair of wireless headphones such as Air Buds®. A string attachment 81 for the compartment 80 to the back side 66 and snap in tech is also provided. A strap 82 for holding or hanging the backpack 60 when not in use is situated at the top edge of the main body 62. In addition, a flexible straw 84 connected to a reusable flexible water or fluid container 86 which is housed in a pouch 88 is also provided. A rib strap 90 also extends across the lower back portion of the main body 62 of the backpack 60. FIGS. 16 and 17 illustrate the laptop wedge case 92 in main body 62, which connects to laptop sleeve 68 having a slippery lining for easier laptop insert, and also has an elastic top closing. A drawstring 94 situated near the top portion is shown, and a memory foam back padding 96 is also shown in main body 62 situated behind the laptop wedge case 92.

Figure 18:
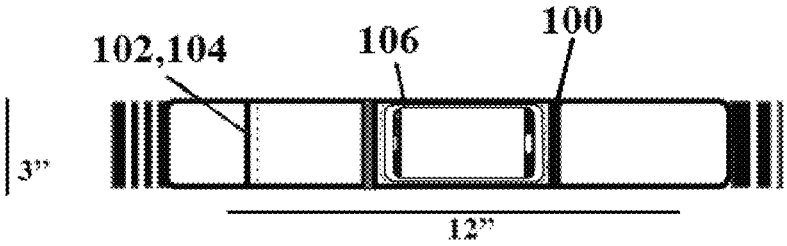
FIG. 18 illustrates an embodiment of a waist belt or strap for use with the wearable training apparatus of the present invention.
Figure 19:
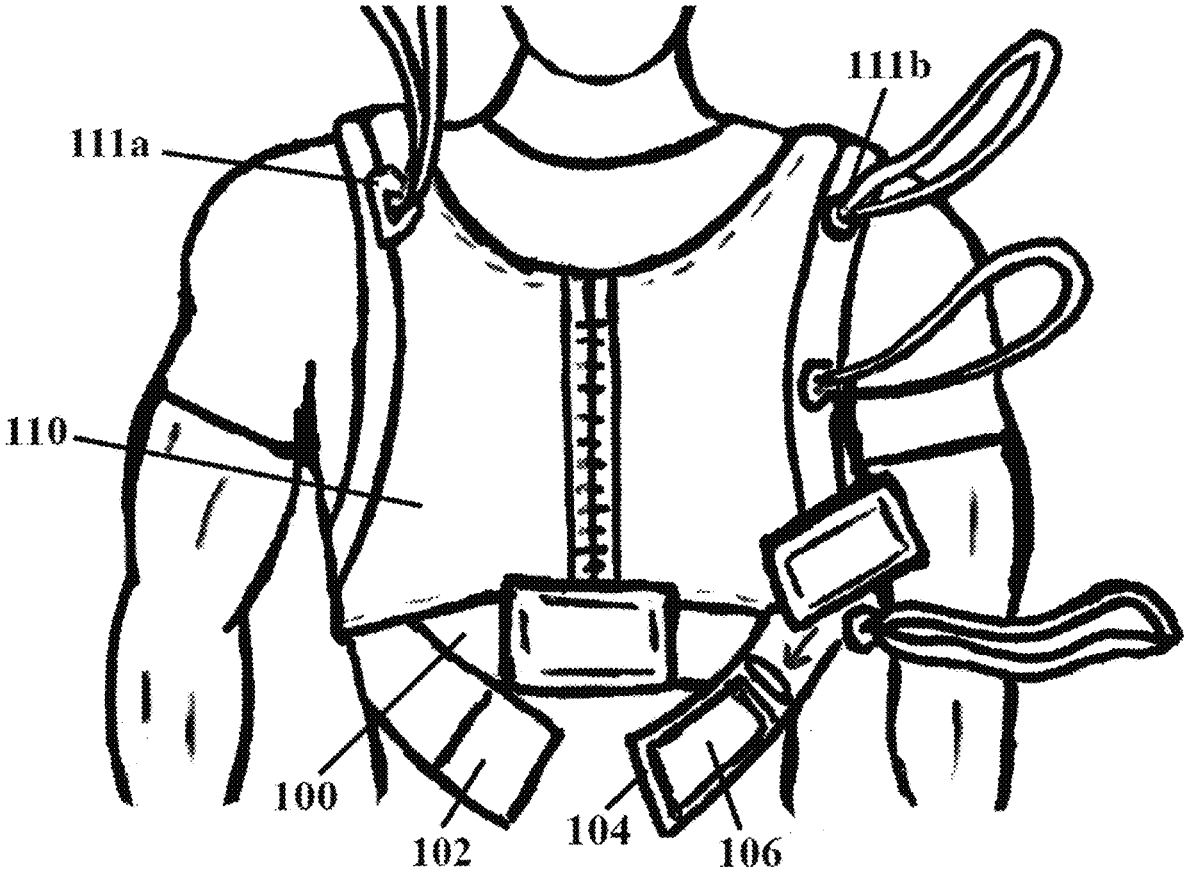
FIG. 19 is a front view of another embodiment of the training apparatus of the present invention.

FIGS. 18 and 19 illustrate an adjustable rib strap 100 which can be attached to the training apparatus 10 extending between the shoulder strap portions 14 and 16. As shown in FIG. 19, wherein another embodiment of the training apparatus is illustrated, belt 100 has a hook and loop (e.g., Velcro®) connection between overlapping inner and outer sections 102 and 104. Outer section 104 includes expandable phone case 106 having a clear plastic window, in which phone case a cell phone can be inserted and carried. The phone case 106 can shift two inches to the left or right for center aligning. Backpack 60 may be secured to the training apparatus by attaching loop 82 with short extension 42 of the training apparatus. In addition, the rib strap 90 in some embodiments may be secured extending around the front of the wearer's torso.

Referring still to FIG. 19, the training apparatus in such illustrated embodiment also includes a zippered vest-like garment portion 110 which connects between the first and second strap portions over the front torso. In addition, as indicated above a rib strap similar to the rib strap 100 shown in FIG. 18 is connected to the lower end of the garment portion 110, and has an adjustable belt to adjust the snugness of the training apparatus on the wearer's body. The garment portion 110 may be made of cloth or an elastic material and will aid in maintaining the straps in a desired position on the user's body. FIG. 19 also illustrates an alternative glide clip arrangement 111*a* for extending and retracting the resistance bands in the shoulder strap portions, wherein the glide clip 111*a* is slidable longitudinally along the shoulder strap portions in order to extend or release the resistance band from the straps. In another alternative embodiment also illustrated in FIG. 19, pull bands 111*b* are positioned at spaced-apart holes along the shoulder strap portions, which may be individual or separate bands or a single resistance band. In another alternative embodiment, the shoulder strap portion 12 of the invention may be formed of a strap material panel and a plurality of spaced apart loops attached to a side of the panel, similar to belt loops, rather than being formed as a sleeve with openings cut in the sleeve, with the resistance band 28 positioned underneath the loops. In still another embodiment, the training apparatus can be formed as an upper body garment having short or long sleeves, or as a body suit.

Figure 20:
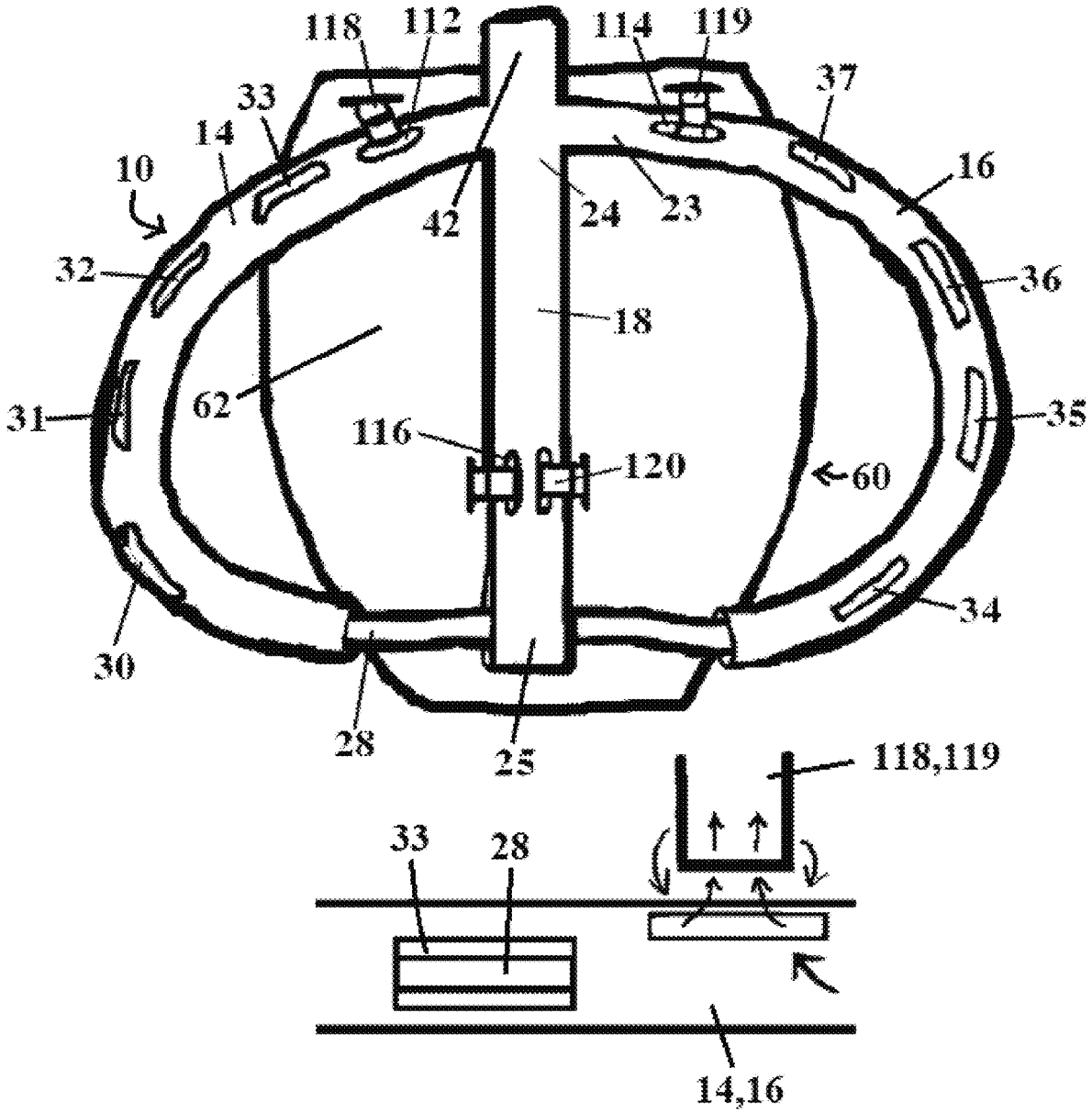
FIG. 20 is a rear view showing a manner of attachment of the backpack main body to the wearable training apparatus.

FIG. 20 illustrates another arrangement for securing the backpack 60 to the resistance band training apparatus 10. In such arrangement, slots 112 and 114 are provided in an upper or proximal end area 23 and 25 of shoulder strap portions 14 and 16, respectively, preferably between cutout 33 and extension 42 on shoulder strap portion 14 and between cutout 37 and extension 42 on shoulder strap portion 16. In addition, another slot 116 is provided in back portion 18 at an intermediate position between proximal end 24 and distal end 25. Hook and loop straps 118, 119, and 120 are attached to main body 62 of the backpack 60 in positions for the straps to be passed through slots 112, 114, and 116, respectively and their ends secured by the hook and loop connectors on the straps. The slots 112, 114, and 116 will be positioned so as not to interfere with use of the resistance band 28. It will be understood that other arrangements for securing the backpack 60 to the resistance band training apparatus 10, such as the use of heavy duty snaps, clips or other fasteners may be utilized while still falling within the intended scope of the present invention.

Figure 21:
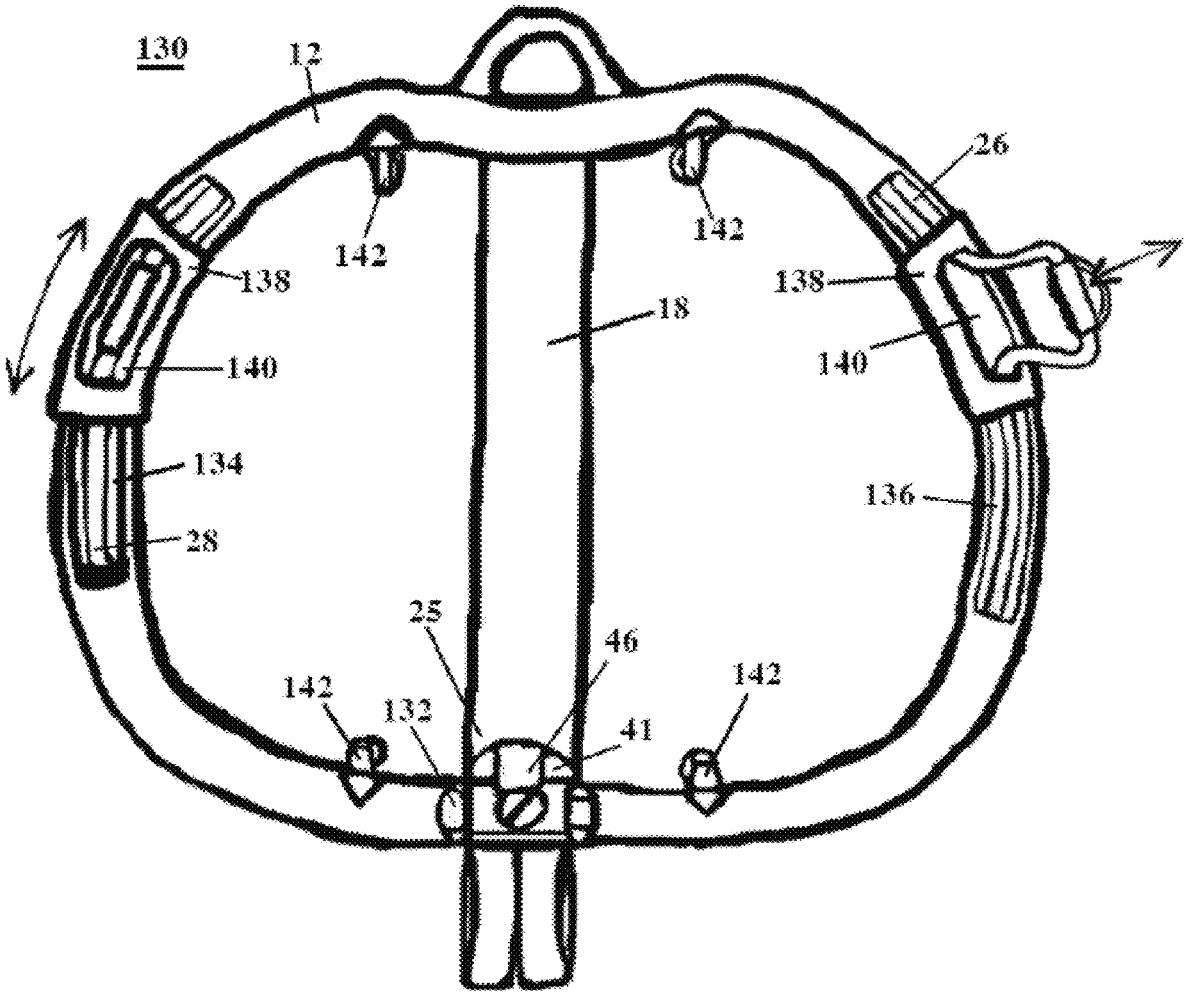
FIG. 21 illustrates another embodiment of the wearable training apparatus of the present invention.

FIG. 21 illustrates another embodiment of the wearable exercise apparatus 130, which is similar to the embodiment shown in FIGS. 1-4 in that a shoulder strap 12 having an internal compartment or channel 26 is provided in which a resistance band 28 is housed. In this version, however, the shoulder strap 12 is formed as a continuous loop such that the resistance band 28 which is also provided as a continuous loop is largely completely covered except for the access openings formed in the strap 12, and another access opening 132 near the bottom side of the strap 12. Lateral extension 18 may also be somewhat longer such that distal end 25 is aligned with access opening 132. A portion of the band 28 may be pulled outwardly through access opening 132 and passed through end aperture 38 in the lateral extension 18. The portion of the band 28 is then secured and the looped end portion 46 inserted in pouch 41 as in the previous embodiment.

Figure 22:
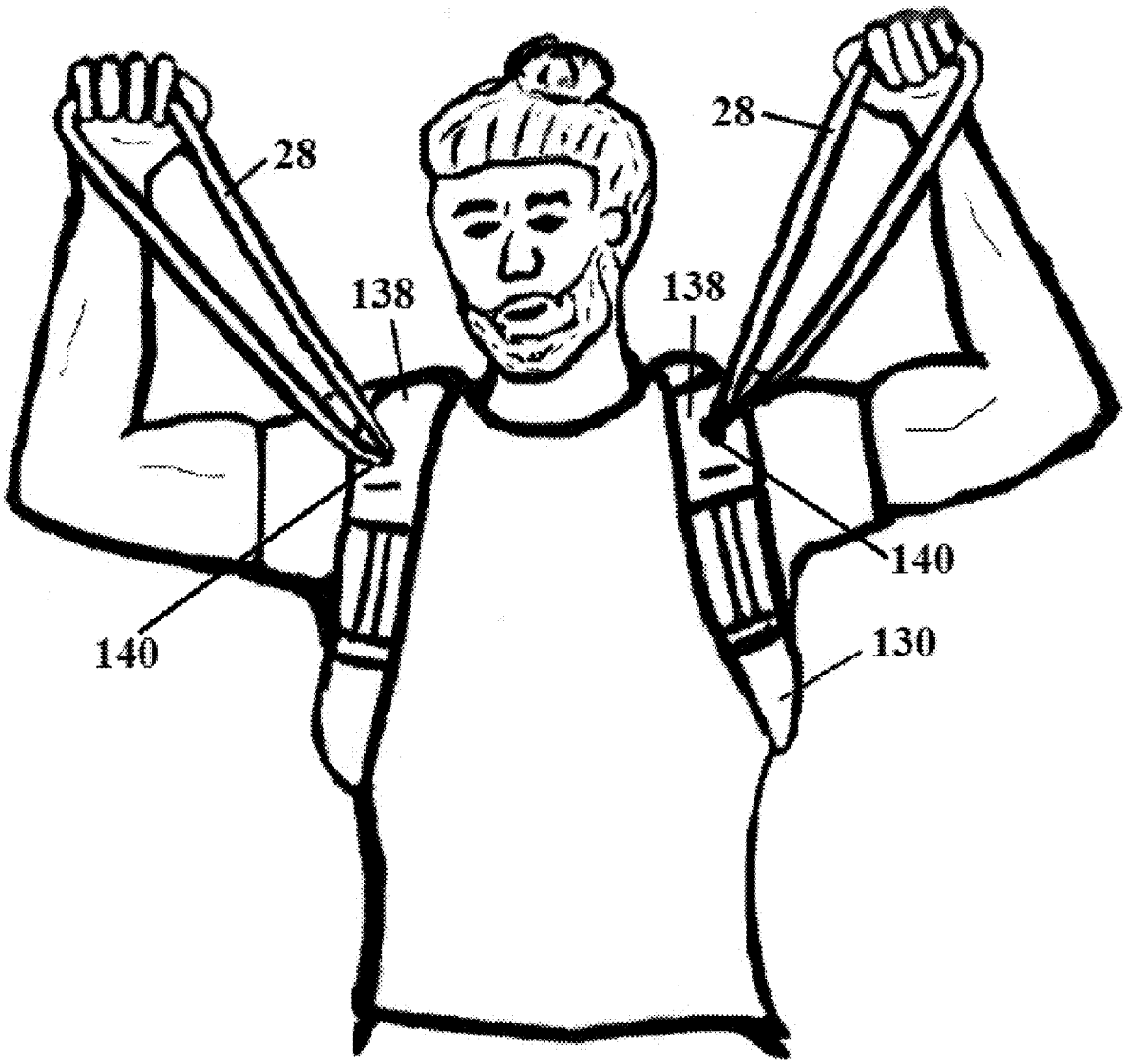
FIG. 22 illustrates a manner of use of the embodiment of the wearable training apparatus shown in FIG. 21.
Figure 23:
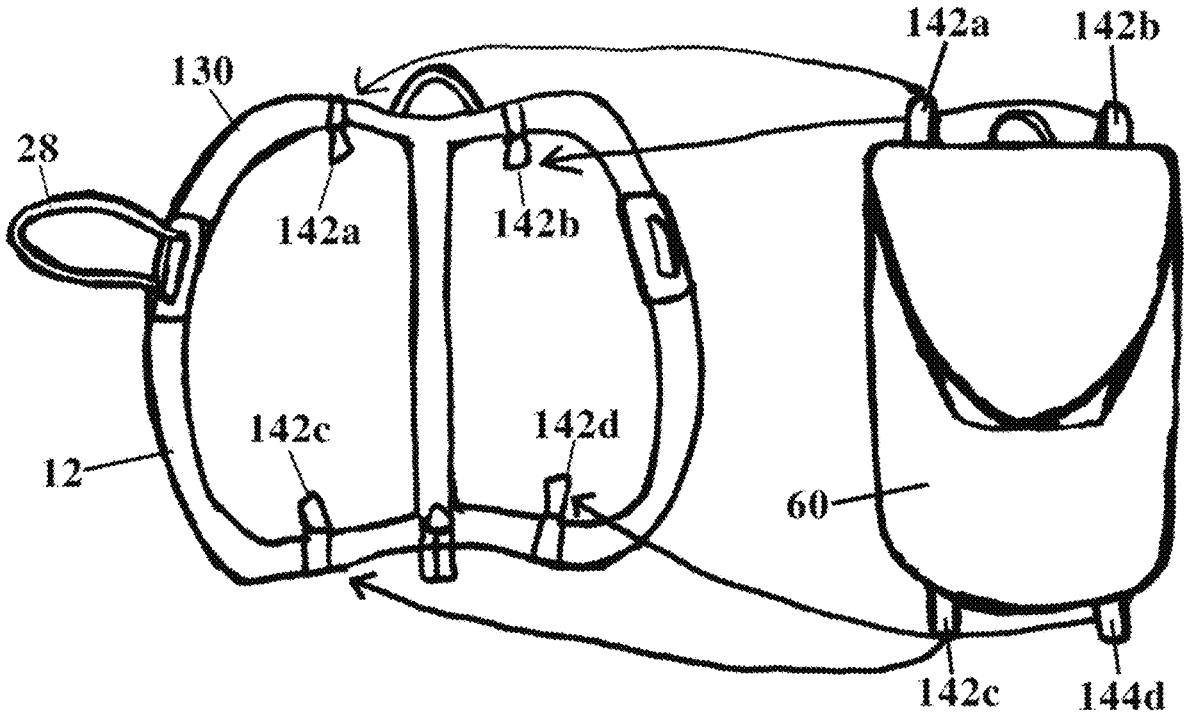
FIG. 23 illustrates another manner of attachment of a backpack to the wearable training apparatus.

In addition, rather than having several access openings on each of first and second shoulder strap portions 14 and 16, a pair of wider access openings 134 and 136 are provided, and a slidable member 138 is provided on strap 12, which members 138 are slidable along a longitudinal length of the strap 12 in the openings 134 and 136. Members 138 each have an access opening 140 which is aligned with openings 134 and 136 in the strap 12 through which the resistance band 28 can be manually grasped and pulled outwardly through the access opening 140 to perform a desired resistance band exercise. Access opening 140 in slidable members 138 is similar in width to the plurality of spaced-apart access openings 30-37 formed in the strap sections 14 and 16 shown in FIG. 1. Slidable member 138 such serves a similar purpose as the plurality of spaced-apart openings in that member 138 may be slid upwardly or downwardly so as to be in closer proximity to the natural original point of the exercise being performed, improving the usability of the exercise apparatus as compared to a single band attached at two more widely spaced apart tension points. FIG. 22 illustrates a preferred manner of wearing and utilizing the exercise apparatus 130, which is shown in use performing a standing shoulder press exercise, with slidable members 138 being slid to the upper area of the access openings 134 and 136, and the resistance band 28 being pulled outwardly and upwardly through the access openings 140 in members 138. Exercise apparatus 130 also includes several connectors 142 on strap 12 on either side of lateral extension 18 which are utilized to secure backpack 60 to the strap 12. FIG. 23 illustrates with more particularity a mode of attachment of backpack 60 to the exercise apparatus 130 shown in FIG. 21, wherein the connectors are labelled as 140*a-d* and ties or are hook-and-loop fastener straps secured to exercise apparatus 130, and corresponding loops 144*a-d* are shown on backpack 60. It will be understood that the ties 140*a-d* each may be secured to corresponding loop 144*a-d* on the backpack 60. Other attachment arrangements may be utilized, although it is preferred that flexible or soft fasteners be utilizes as they are less likely to interfere with use of the exercise apparatus 130 in performing resistance movements in accordance with the preferred embodiments of the invention.

The foregoing description has been presented for purposes of illustration and description and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. A wearable resistance training apparatus configured to be worn on a user's upper body comprising:

an elongated elastic resistance device;

a sleeve having a side wall, a first end and an opposing second end, and a channel extending between the first end and second end in which at least a portion of the elastic resistance device is received so as to at least partially envelope the elastic resistance device, the sleeve having a plurality of spaced-apart openings in the side wall through which the elastic resistance device is accessible to the user for performing resistance exercises; and a laterally extending back portion having a proximal end connected to the sleeve at a location spaced apart from the first and second ends of the sleeve, a distal end, and an aperture spaced from the distal end through which a portion of the elastic resistance device is received and secured.

2. The resistance training apparatus of claim 1 wherein the elastic resistance device further comprises a continuous closed loop.

3. The resistance training apparatus of claim 1 additionally comprising a pocket formed in the laterally extending back portion having an open outer end configured to receive a portion of the elastic resistance device passed through the aperture in the laterally extending back portion, for adjusting a usable length and tension of the elastic resistance device.

4. The resistance training apparatus of claim 3 additionally comprising a cover panel attached extending outwardly from the open outer end of the pocket formed in the laterally extending back portion configured for covering the portion of the elastic resistance device passed through the aperture in the laterally extending back portion.

5. The resistance training apparatus of claim 1 wherein the sleeve additionally comprises a first portion extending between the first end and the laterally extending back portion, and a second portion extending between the opposing second end and the laterally extending back portion, the first and second portions forming shoulder straps.

6. The resistance training apparatus of claim 1, wherein the resistance apparatus is a resistance band.

7. An exercise training apparatus comprising:

shoulder straps configured to be worn over a respective shoulder of a user and suspending the exercise training apparatus on the user's body, and a panel connecting between the shoulder straps configured to be positioned over the user's upper torso;

each of the shoulder straps having a plurality of loops in a side wall of the shoulder straps, said loops being spaced apart and positioned and adapted to secure a resistance band to the shoulder straps, wherein the resistance band is accessible and extendable between the loops for performing resistance training exercises; and one or more holes in a side wall of the shoulder straps, wherein the resistance band is secured in the shoulder strap and is extendable through said one or more holes into a use position.

8. The exercise training apparats of claim 7 additionally comprising a tension adjustable belt connecting between the shoulder straps.

9. The exercise training apparatus of claim 7 wherein the tension adjustable belt is worn extending around the back of the user.

10. The exercise training apparatus of claim 9 wherein the tension adjustable belt further comprises overlapping inner and outer sections which are detachably connectable using a hook and loop fastener material.

11. The exercise training apparatus of claim 10 additionally comprising an expandable pocket in the outer section of the tension adjustable belt configured for holding a cell phone.

12. The exercise training apparatus of claim 7 additionally comprising a guide clip which is slidably connected for longitudinal sliding on each of the shoulder straps, said guide clips including a loop for receiving a portion of the resistance band attached to the shoulder strap, wherein sliding of the guide clip will extend or retract the resistance band from the shoulder strap.

13. The exercise training apparatus of claim 7 in which resistance bands with different resistance levels are attached to the shoulder strap to be extended from different holes in the shoulder straps.

14. A wearable resistance training apparatus configured to be worn on a user's upper body comprising:

an elongated elastic resistance device;

a shoulder strap having a side wall and including a first shoulder strap portion having a proximal end and a distal end, and a second shoulder strap portion having a proximal end and a distal end, the first and second shoulder strap portions each configured to be worn over a respective shoulder of a user;

a back portion extending laterally from the shoulder strap at an intersection between the proximal ends of the first shoulder strap portion and second shoulder strap portion;

a longitudinally extending channel in the shoulder strap extending between the distal end of the first shoulder strap portion and the distal end of the second shoulder strap portion, said channel configured to receive the elastic resistance device in the channel;

a plurality of spaced-apart openings in the side wall of the shoulder strap through which the elastic resistance device is extendable from the channel for the user to perform resistance exercises, at least one of said openings located in the first shoulder strap portion and at least another of said openings located in the second shoulder strap portion, and wherein the elastic resistance device is retractable into the shoulder strap when not in use;

said elastic resistance device adjustably securable to the laterally extending back portion.

15. The wearable resistance training apparatus of claim 14 wherein the laterally extending back portion further comprises a proximal end connected to the shoulder strap and a distal end, and at least one aperture in the back portion configured for receiving a looped portion of the elastic resistance device to secure the elastic resistance device to the back portion.

16. The wearable resistance training apparatus of claim 14 further comprising connector on the shoulder strap and back portion configured to secure a backpack to the resistance training apparatus.

17. The wearable resistance training apparatus of claim 14 wherein the elastic resistance device is detachably secured in the channel of the shoulders strap.

18. The wearable resistance training apparatus of claim 14 further comprising a first slidable member on a portion of the elastic resistance device located in the first shoulder strap portion and a second slidable member on a portion of the elastic resistance device located in the second shoulder strap portion, and an access opening in said slidable members through which the user can grip and extend the elastic resistance device.

19. The wearable resistance training apparatus of claim 14 wherein the elongated elastic resistance device is comprised of separate resistance devices secured in the first shoulder strap portion and the second shoulder strap portion.

20. The wearable resistance training apparatus of claim 14 wherein the resistance training apparatus is configured to couple an adjustable waist belt to the distal end of the back portion.

* * * * *